US006250891B1

(12) United States Patent
Kawaguchi et al.

(10) Patent No.: US 6,250,891 B1
(45) Date of Patent: Jun. 26, 2001

(54) VARIABLE DISPLACEMENT COMPRESSOR HAVING DISPLACEMENT CONTROLLER

(75) Inventors: Masahiro Kawaguchi; Hideki Mizutani; Kiyohiro Yamada; Hiroyuki Nakaima, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/470,380

(22) Filed: Dec. 22, 1999

(30) Foreign Application Priority Data

Dec. 22, 1998 (JP) ..... 10-364471

(51) Int. Cl.[7] ..... F04B 1/26
(52) U.S. Cl. ..... 417/222.2; 417/269
(58) Field of Search ..... 417/269, 222.2, 417/222.1; 92/12.2, 71

(56) References Cited

U.S. PATENT DOCUMENTS 4,475,871 10/1984 Roberts ..... 417/222
5,231,914 * 8/1993 Hayase et al. ..... 92/12.2
5,375,981 * 12/1994 Fujii et al. ..... 417/269
5,486,098 * 1/1996 Kimura et al. ..... 417/222.2
5,533,870 * 7/1996 Takenaka et al. ..... 417/269
5,588,807 * 12/1996 Kimura et al. ..... 417/222.2
5,636,973 * 6/1997 Sonobe et al. ..... 417/222.2
5,857,402 * 1/1999 Hoshida et al. ..... 92/12.2
5,897,298 * 4/1999 Unemura ..... 417/222.2
5,974,946 * 11/1999 Kanou et al. ..... 92/71
6,077,047 * 6/2000 Nahai et al. ..... 417/222.1

* cited by examiner

*Primary Examiner*—Philip H. Leung
*Assistant Examiner*—Leonid Fastovsky
(74) *Attorney, Agent, or Firm*—Morgan & Finnegan, LLP

(57) ABSTRACT

A variable displacement compressor that varies the gas displacement by controlling the pressure in a crank chamber including a drive shaft, pistons for compressing the gas, and a swash plate. The swash plate is located in the crank chamber and integrally rotates with the drive shaft, and varies the stroke of the pistons. The inclination of the swash plate relative to the drive shaft is varied between maximum and minimum positions. A displacement restoration spring inclines the swash plate. One end of the restoration spring fixed to a predetermined part of the drive shaft.

17 Claims, 6 Drawing Sheets

VARIABLE DISPLACEMENT COMPRESSOR HAVING DISPLACEMENT CONTROLLER

BACKGROUND OF THE INVENTION

The present invention relates to a variable displacement compressor. More specifically, the present invention pertains to a controller for controlling the inclination of a swash plate in a variable displacement compressor.

Japanese Examined Patent Publication No. 2-9188 describes a swash plate type variable displacement compressor. The compressor includes a swash plate and pistons. The swash plate, which is located in a crank case (pressure control chamber), integrally moves with a drive shaft and inclines with respect to the drive shaft. The strokes of the pistons vary in accordance with the inclination of the swash plate. When the pressure in the crankcase is relatively high, the inclination of the swash plate is small, which causes the compressor to operate at a small displacement. When the pressure in the crankcase is relatively low, the inclination of the swash plate is large, which causes the compressor to operate at a large displacement. Adjusting the pressure in the crankcase controls the displacement of the compressor. It is important to determine a precise minimum inclination position of the swash plate and to precisely control the inclination of the swash plate. In the compressor described in Publication 2-9188, the swash plate is located between two springs, that is, a displacement restoration spring and an inclination reduction spring. The restoration spring is located between a snap ring fixed on the drive shaft and a hinge ball supporting the swash plate on the drive shaft. The restoration spring continuously contacts the hinge ball and urges the swash plate to incline. The restoration spring increases the inclination of the swash plate from the minimum inclination position and helps restore the displacement. The restoration spring also precisely determines the minimum inclination position of the swash plate, which reduces power consumption.

To maintain a certain minimum inclination of the swash plate, the minimum inclination is determined by the minimum length of the restoration spring (the length when fully compressed). The longer the restoration spring is when uncompressed, the longer it is when compressed. Therefore, the uncompressed length of the restoration spring also determines the distance between the hinge ball and the snap ring at the minimum inclination position of the swash plate. In other words, the longer the uncompressed length of the restoration spring is, the greater the distance between the hinge ball and the snap spring at the minimum inclination position becomes, which increases the axial length of the compressor.

To reduce the distance between the hinge ball and the snap spring at the minimum inclination position, the characteristic of the restoration spring may be changed. For example, the length of the spring may be reduced and the spring may be hardened. However, if the length of the restoration spring is less than the distance between the hinge ball and the snap ring at the maximum inclination, the spring moves along the drive shaft, which may cause noise and damage the compressor.

SUMMARY OF THE INVENTION

An objective of the present invention is to provide a compact compressor that prevents producing noise and damaging the compressor.

To achieve the above objective, the present invention provides a variable displacement compressor. The displacement is varied by controlling the pressure in a crank chamber. The compressor includes a drive shaft, a piston for compressing a gas, a swash plate located in the crank chamber, and a displacement restoration spring. The swash plate integrally rotates with the drive shaft. The inclination of the swash plate relative to the drive shaft determines the stroke of the piston. The inclination of the swash plate is varied between a maximum inclination position and a minimum inclination position. The displacement restoration spring urges the swash plate to increase its angle. The restoration spring fails to urge the swash plate when the swash plate is positioned at or near the maximum inclination position. One end of the restoration spring being fixed to a predetermined part of the drive shaft.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of the present invention will now be described with reference to FIGS. 1–6.

Figure 1:
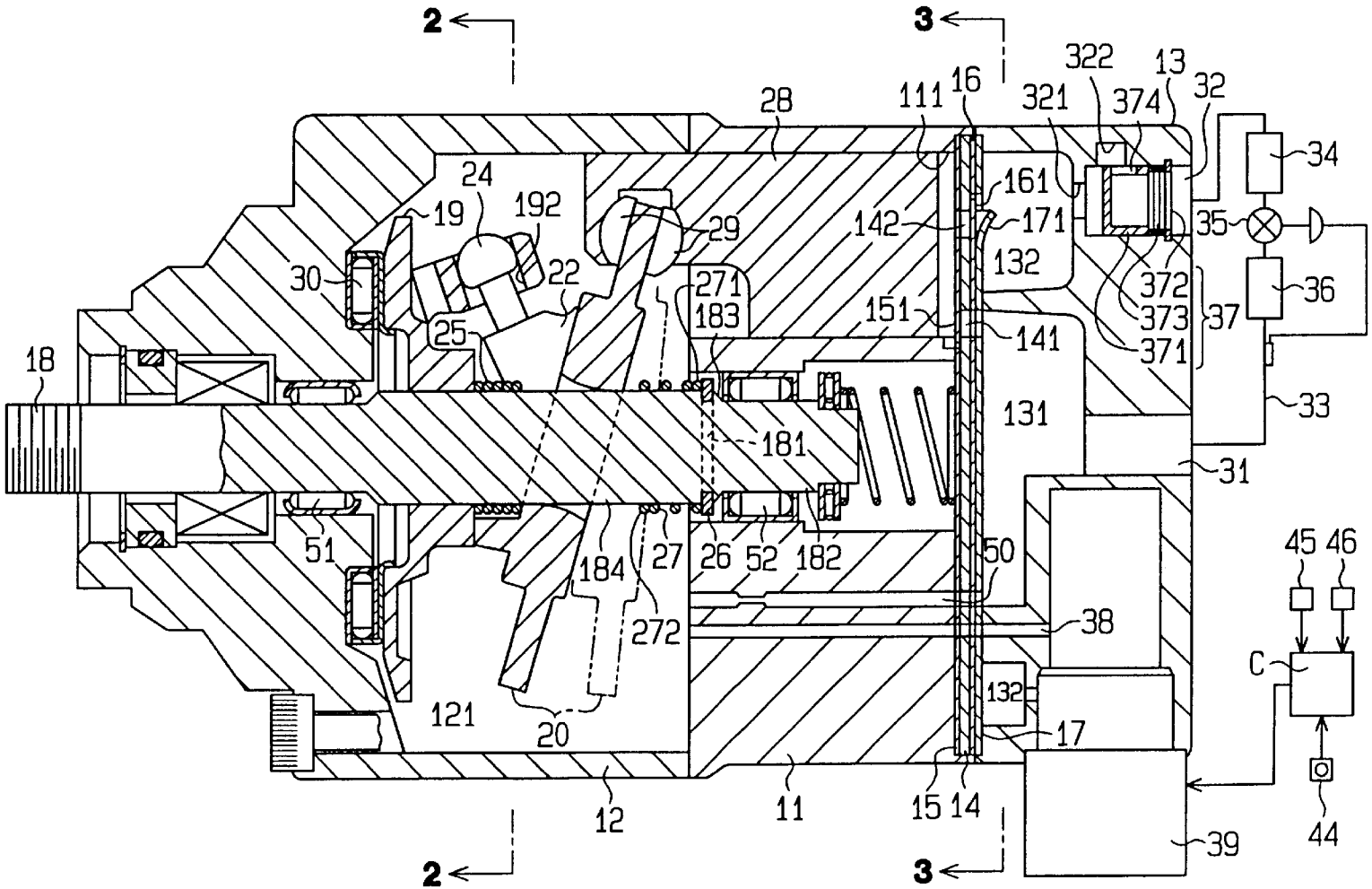
FIG. 1 is a longitudinal cross sectional view of a compressor according to a first embodiment of the present invention.

As shown in FIG. 1, a front housing member 12 is fixed to the front end of a cylinder block 11. A rear housing member 13 is fixed to the rear end of the cylinder block 11 through a valve plate 14, valve formation plates 15, 16, and a retainer formation plate 17. A crank chamber (pressure control chamber) 121 is defined between the front housing member 12 and the cylinder block 11. A drive shaft 18 extends through the crank chamber 121. A front end (left end in FIG. 1) of the drive shaft 18 is located outside of the crank chamber 121 and is driven by an external drive source, or a vehicle engine (not shown), through a pulley and a belt (not shown). The front end of the drive shaft 18 is rotatably supported by the front housing member 12 through a radial bearing 51, and the rear end (right end in FIG. 1) is rotatably supported by the cylinder block 11 through a radial bearing 52.

Figure 2:
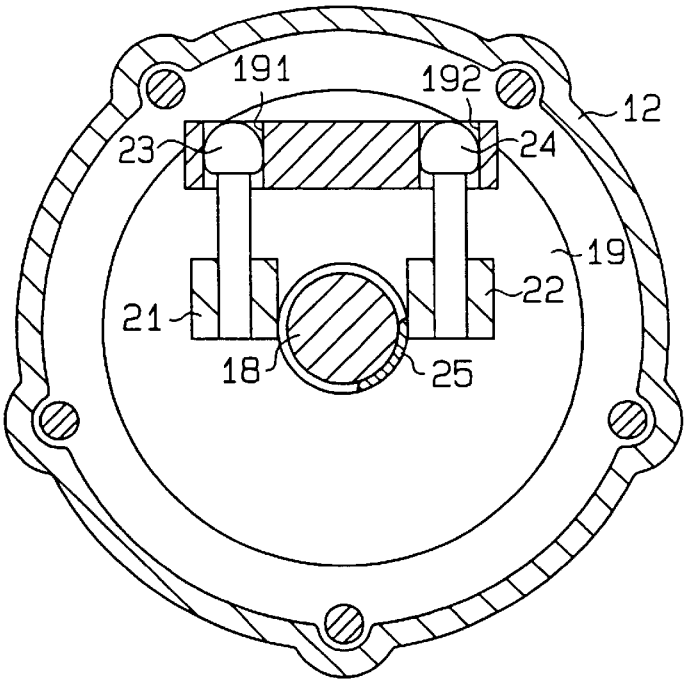
FIG. 2 is a cross sectional view taken on line 2—2 of the compressor of FIG. 1.

A lug plate 19 is fixed to the drive shaft 18. As shown in FIG. 2, a swash plate includes a pair of connection pieces 21, 22. Guide pins 23, 24 respectively project from the corresponding connection pieces 21, 22. The lug plate 19 includes a pair of guide holes 191, 192. The heads of the guide pins 23, 24 are respectively received in the corresponding guide holes 191, 192. The swash plate integrally rotates with the drive shaft 18 and inclines with respect to the drive shaft 18 in accordance with the positions of the guide pins 23, 24 in the guide holes 191, 192.

Figure 4:
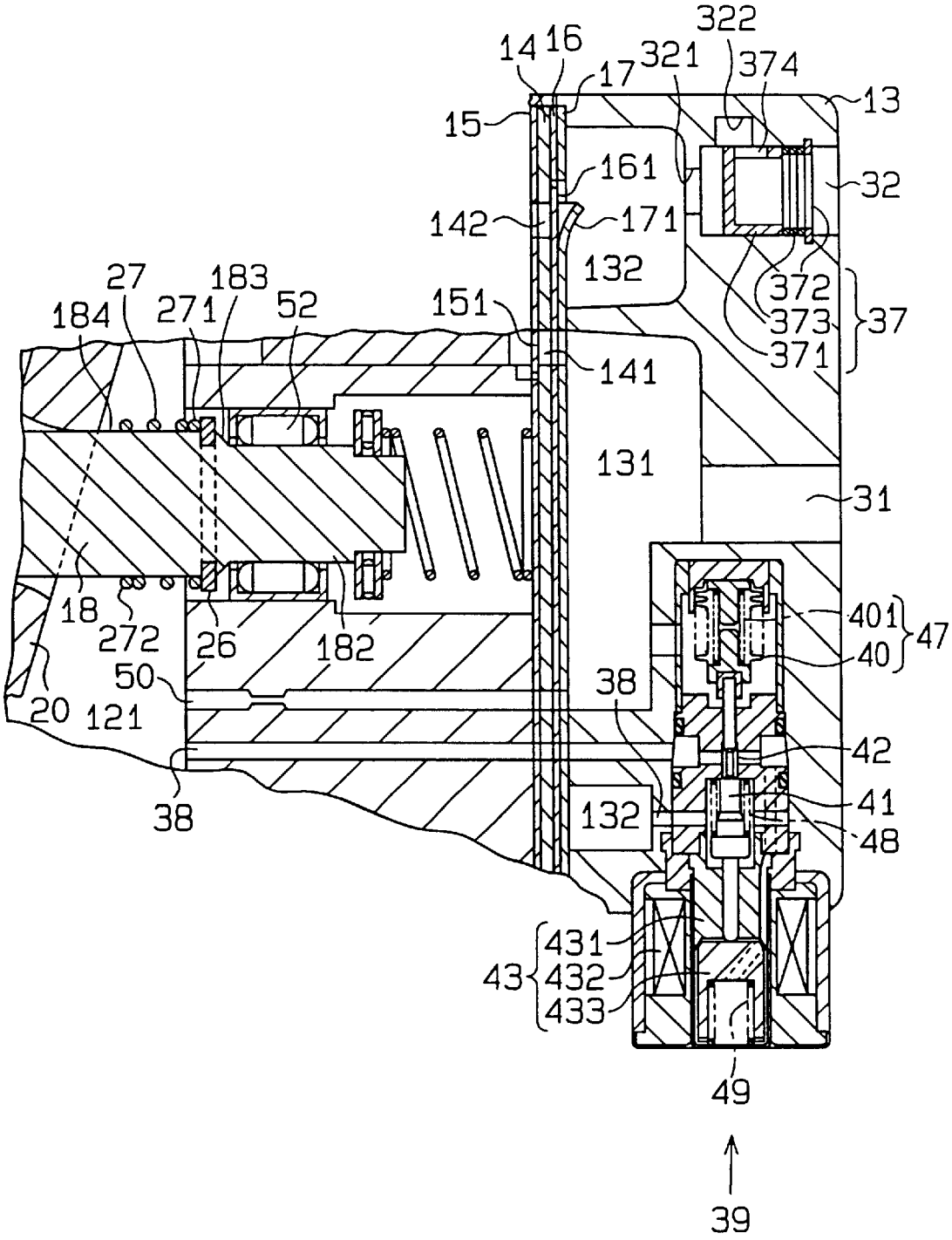
FIG. 4 is a partial cross sectional view showing the swash plate at the maximum inclination position.

When the swash plate 20 moves toward the lug plate 19, the inclination of the swash plate increases. The maximum inclination of the swash plate 20 is limited by the abutment of the lug plate 19 against the swash plate 20. FIGS. 1 and 4 show the swash plate 20 at the maximum inclination position. An inclination reduction spring 25 is located between the lug plate 19 and the swash plate 20. The reduction spring 25 urges the swash plate 20 away from the lug plate 19, that is, it tends to reduce the inclination of the swash plate 20.

Figure 5:
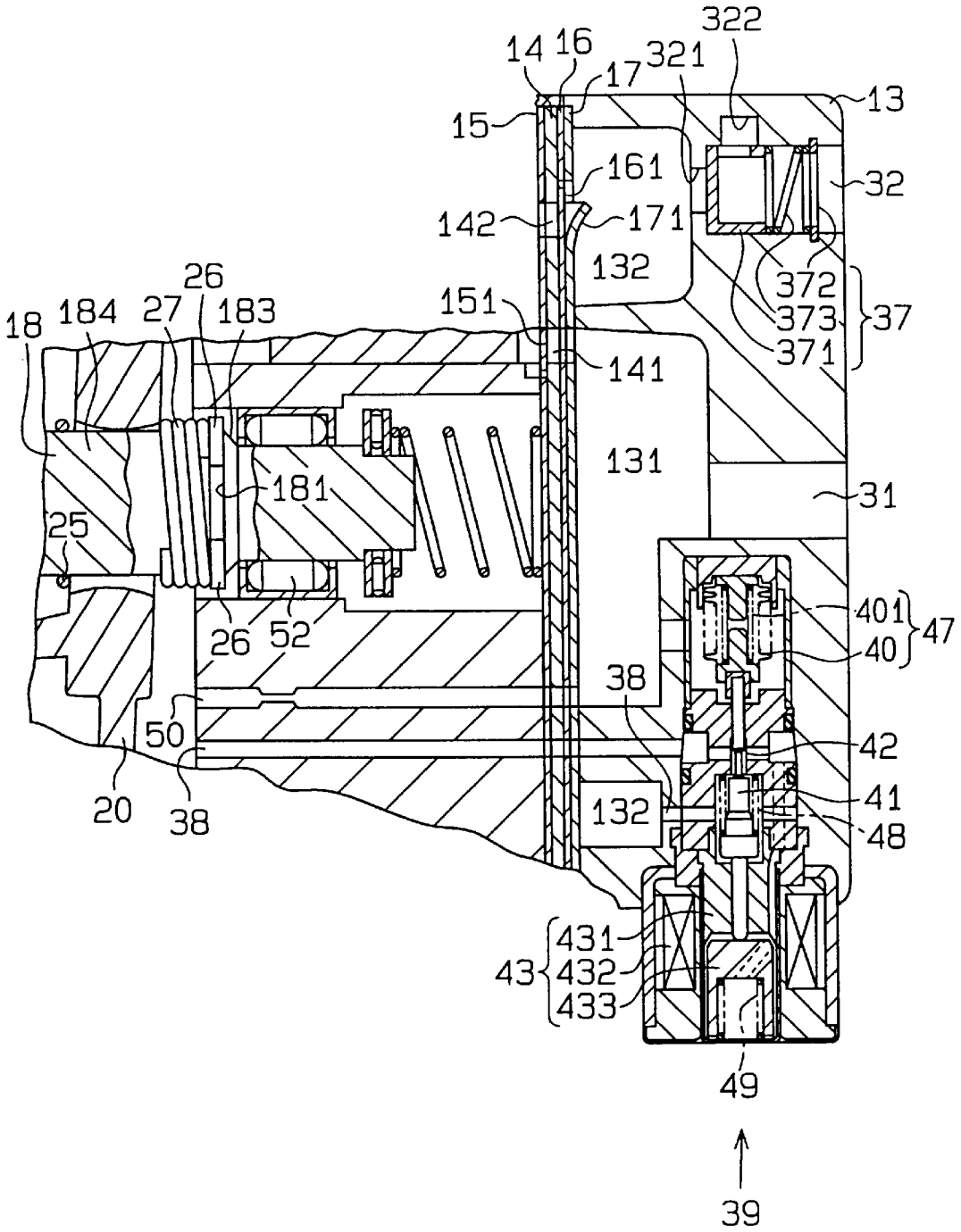
FIG. 5 is a partial cross sectional view showing the swash plate at the minimum inclination position.

An annular positioning groove 181 is formed on the drive shaft 18 between the swash plate 20 and the radial bearing 52. A snap ring 26 is fitted in the positioning groove 181. A restoration spring 27 is located between the swash plate 20 and the snap ring 26. The proximal end 271 of the restoration spring 27 is fixed to the snap ring 26. The length of the restoration spring 27, when no force is applied, is less than the distance between the swash plate 20 and the snap ring 26 when the swash plate 20 is in the maximum inclination position. Since the proximal end 271 is fixed to the snap ring 26, the restoration spring 27 is prevented from moving along the drive shaft 18. As the distance between the lug plate 19 and the swash plate 20 increases, the inclination of the swash plate 20 decreases. When the swash plate 20 decreases, the swash plate 20 contacts and compresses the restoration spring 27. When the restoration spring is compressed to its limit, the inclination of the swash plate 20 is minimized. FIG. 5 shows the swash plate at the minimum inclination position. The minimum inclination angle of the swash plate 20 with respect to a plane perpendicular to the drive shaft 18 is slightly larger than zero degrees.

Figure 6:
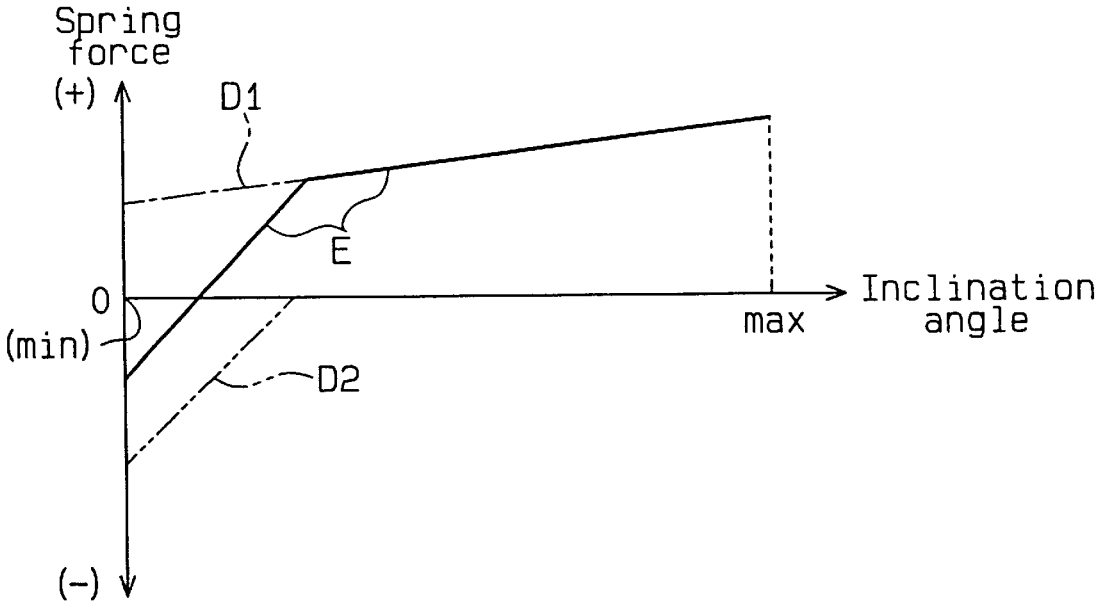
FIG. 6 is a graph showing the compressor displacement, or inclination angel on the horizontal axis, and the resultant force of the inclination reduction spring and the displacement restoration spring on the vertical axis.

In FIG. 6, the line D1 shows the characteristics of the reduction spring 25, and the line D2 shows the characteristics of the restoration spring 27. The bent line E shows the synthesized characteristics of the springs 25, 27.

The cylinder block 11 includes cylinder bores 111, which respectively accommodate the pistons 28. Rotation of the swash plate 20 is converted into reciprocation of the pistons 28 in the cylinder bores 111 through shoes 29.

Figure 3:
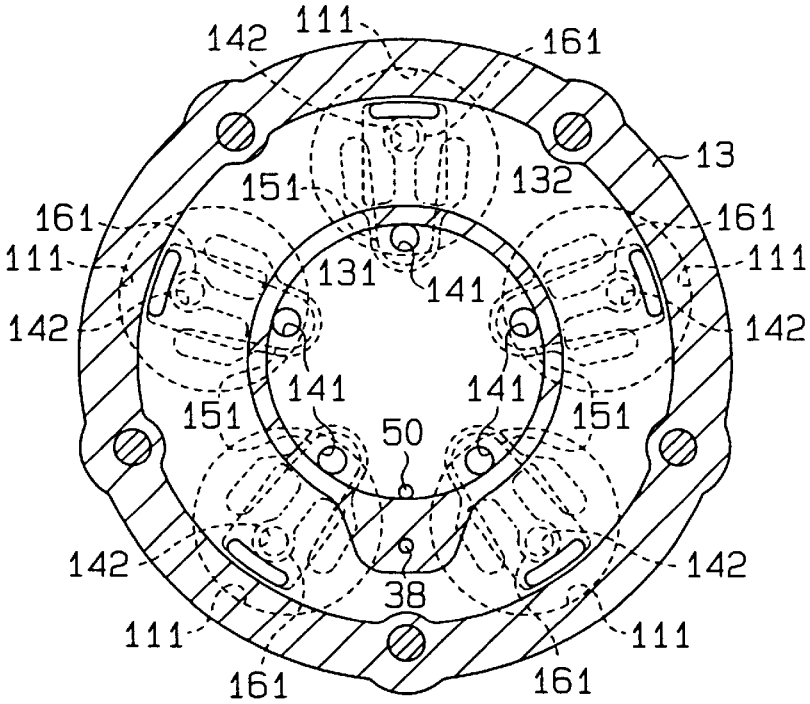
FIG. 3 is a cross sectional view taken on line 3—3 of the compressor of FIG. 1.

As shown in FIGS. 1 and 3, a suction chamber 131 and a discharge chamber 132 are defined by the rear housing 13 and the plate 17. Suction ports 141 and discharge ports 142 are formed in the valve plate 14 and the valve formation plates 15, 16. The valve formation plate 15 includes suction valves 151, and the valve formation plate 16 includes discharge valves 161. During the suction stroke of the pistons 28, the suction valves 151 permit refrigerant gas in the suction chamber 131 to flow to the cylinder bores 111 through the corresponding suction ports 141. Refrigerant gas in the cylinder bores 111 is compressed by the pistons and is discharged to the discharge chamber 132 through the discharge ports 142. Flow from the cylinder bores 111 to the discharge chamber 132 is permitted by the discharge valves 161. Retainers 171, which are formed on the retainer formation plate 17, limit the movement of the corresponding discharge valves 161.

A thrust bearing 30 is located between the lug plate 19 and the front housing member 12. The thrust bearing 30 receives a discharge reaction force applied to the lug plate 19 from the cylinder bores 111 through the pistons 28, the shoes 29, the swash plate 20, the connection pieces 21, 22, and the guide pins 23, 24.

An external refrigerant circuit 33 connects a suction passage 31 to a discharge passage 32. The suction passage 31 introduces refrigerant gas to the suction chamber 131, and the discharge passage 32 receives refrigerant gas from the discharge chamber 132. The external refrigerant circuit 33 includes a condenser 34, an expansion valve 35, and an evaporator 36. The expansion valve 35 is a temperature-controlled automatic expansion valve, which controls the flow rate of refrigerant in accordance with the fluctuation of gas temperature in the outlet of the evaporator 36.

A restriction valve 37 is accommodated in the discharge passage 32. The restriction valve 37 includes a cup-shaped valve body 371, a snap ring 372, and a spring 373. The valve body 371 slides axially in the discharge passage 32, the snap ring is fixed on the inner wall of the discharge passage 32, and the spring 373 is located between the snap ring 372 and the valve body 371. The valve body 371 closes a valve hole 321. The spring 373 urges the valve body 371 toward the valve hole 321. A bypass 322 is formed in the discharge passage 32 between the valve hole 321 and the snap ring 372. The bypass 322 forms part of the discharge passage 32. A bypass hole 374 is formed in the peripheral wall of the valve body 371. When the valve body 371 is at the opened position shown in FIGS. 1 and 4, refrigerant gas in the discharge chamber 132 flows to the external refrigerant circuit 33 by way of the valve hole 321, the bypass 322, the bypass hole 374, and the hollow center of the valve body 371. As shown in FIG. 5, the valve body 371 closes the valve hole 321 when at its closed position, which prevents refrigerant gas from flowing from the discharge chamber 132 to the external refrigerant circuit 33.

As shown in FIG. 4, a displacement control valve 39 is located in a pressurizing passage 38, which connects the discharge chamber 132 to the crank chamber 121. A bleed passage 50 connects the crank chamber 121 to the suction chamber 131. Refrigerant gas in the crank chamber 121 flows to the suction chamber 131 through the bleed passage 50.

The control valve 39 includes a bellows 40, which forms part of a pressure sensing device 47. The pressure in the suction chamber 131 is applied to the bellows 40 by refrigerant gas. The pressure in the suction chamber 131 reflects the cooling load on the compressor. The bellows 40 is connected to a valve body 41. The valve body 41 closes a valve hole 42. An opener spring 48 urges the valve body to open the valve hole 42. The air pressure in the bellows 40 and a pressure-sensitive spring 401 urge the valve body 41 to open the valve hole 42. A solenoid 43 includes a fixed iron core 431, a coil 432, and a movable iron core 433. When electric current is applied to the coil 432, the movable core is attracted to the fixed core 431. That is, the solenoid 43 urges the valve body 41 to close the valve hole 42 against the force of the opener spring 48. A follower spring 49 urges the movable core 433 toward the fixed core 431. A computer C controls the current supply to the solenoid 43.

The opening size of the valve hole 42 is determined by the equilibrium of forces including an electromagnetic force generated at the solenoid 43, the force of the follower spring 49, the force of the opener spring 48, and the force of the pressure sensing device 47. The computer C supplies a current to the solenoid 43 when an air-conditioner operation switch 44 is turned on, and stops the current supply when the operation switch 44 is turned off. The computer C is connected to a temperature adjuster 45 and a temperature detector 46. The computer C controls the current supply to the solenoid 43 based on information including a target temperature set by the temperature adjuster 45 and the temperature in the passenger compartment detected by the temperature detector 46. The opening size of the valve hole 42 is adjusted by the current supplied to the solenoid 43, which varies the suction pressure. The opening size of the valve hole 42 is small when the supplied current is great, which reduces the supply of refrigerant gas from the discharge chamber 132 to the crank chamber 121. Since refrigerant gas in the crank chamber 121 continuously flows to the suction chamber 131 through the bleed passage 50, the pressure in the crank chamber 121 gradually decreases. This increases the inclination of the swash plate 20 and the displacement. The increase of the displacement lowers the suction pressure. On the other hand, the opening size of the valve hole 42 is great when the supplied current is small. Since a large amount of refrigerant gas is supplied to the crank chamber 121 from the discharge chamber 132, the pressure in the crank chamber 121 gradually increases. This reduces the inclination of the swash plate 20 and the displacement. The decrease of the displacement increases the suction pressure.

When the current supply to the solenoid 43 is stopped during the operation of the vehicle engine, the opening size of the valve hole 42 is maximized, which moves the swash plate 20 to the minimum inclination position shown in FIG. 5. The discharge pressure of the compressor is low when the swash plate 20 is at the minimum inclination position. When the swash plate 20 is at the minimum inclination position, the force of the gas pressure applied to the upstream end of the restriction valve 37 is smaller than the resultant of the force of the spring 373 and the force of the refrigerant gas pressure applied to the downstream end of the restricting valve 37. Therefore, when the swash plate 20 is positioned at the minimum inclination position, the valve body 371 closes the valve hole 321 and stops the supply of refrigerant gas to the external refrigerant circuit 33.

Since the swash plate 20 is slightly inclined at the minimum inclination position, the pistons 28 continue to discharge refrigerant gas from the cylinder bores 111 to the discharge chamber 132. The refrigerant gas in the discharge chamber 132 flows to the crank chamber 121 through the pressurizing passage 38. The refrigerant gas in the crank chamber 121 flows to the suction chamber 131 through the bleed passage 50. The refrigerant in the suction chamber 131 is drawn to the cylinder bores 111 and is then discharged to the discharge chamber 132. That is, when the swash plate 20 is at the minimum inclination position, a circulation passage is formed in the compressor. The circulation gas passes through the discharge chamber 132, which is a discharge pressure area, the pressurizing passage 38, the crank chamber 121, the bleed passage 50, the suction chamber 131, which is a suction pressure area, and the cylinder bores 111. Since the pressures in the discharge chamber 132, the crank chamber 121, and the suction chamber 131 are different, lubricant oil in the refrigerant gas circulates through the circulation passage and lubricates the compressor parts.

When the current supply to the solenoid 43 is restarted, the opening size of the valve hole 42 is reduced. This reduces the pressure in the crank chamber 121, increases the inclination of the swash plate 20, and increases the discharge pressure. In the discharge passage 32, the force of the gas pressure applied to the upstream end of the restriction valve 37 becomes greater than the resultant of the force of the spring 373 and the force of the gas pressure applied to the downstream end of the restriction valve 37. As a result, the valve hole 321 is opened, which permits refrigerant gas in the discharge chamber 132 to flow to the external refrigerant circuit 33.

When the engine is stopped and the operation of the compressor is stopped, the control valve 39 is de-excited, which temporarily moves the swash plate 20 to the minimum inclination position. Then, the pressure in the compressor gradually becomes uniform. When the pressures of the discharge chamber 132, the crank chamber 121, and the suction chamber 131 are equal, the swash plate 20 is moved from the minimum inclination position to a start inclination position by the force of the restoration spring 27, that is, by the resultant force of the forces of the reduction spring 25 and the restoration spring 27. The inclination of the swash plate 20 at the start inclination position is greater than that of the minimum inclination position. When the swash plate 20 starts rotation at the start inclination position, regardless of the springs 25 and 27, the inclination of the swash plate 20 is rapidly increased by the decrease of pressure in the crank chamber 121, which is due to the closure of the valve hole 42.

When the valve hole 42 is closed by the current supply to the solenoid 43 during the rotation of the swash plate 20, the pressure in the crank chamber 121 becomes less than the pressure in the discharge chamber 132. Therefore, the restoration spring 27 moves the swash plate 20 toward the start inclination position.

When the control valve 39 is de-excited (or fully opened) during the rotation of the swash plate 20, the pressure in the crank chamber 121 becomes greater than the pressure (suction pressure) in the suction chamber 131. Therefore, the swash plate 20 moves to the minimum inclination position against the force of the restoration spring 27.

The inclination of the swash plate 20 at the start inclination position corresponds to a synthesized force of zero. This is represented by the point in FIG. 6 where the bent line E crosses the horizontal axis. Adjusting the characteristics of the reduction spring 25 and the restoration spring 27 varies the start inclination position.

The first embodiment has the following advantages.

(1) The inclination of the swash plate 20 when starting the compressor is the minimum inclination necessary to promptly restore the displacement. When the control valve 39 is de-excited during the rotation of the swash plate 20, the pressure in the crank chamber 121 becomes greater than the pressure (suction pressure) in the suction chamber 131. Therefore, the swash plate 20 is positioned at the minimum inclination position against the force of the restoration spring 27. The restoration spring 27 causes the start inclination of the swash plate 20 to be greater than the minimum inclination.

(2) When the current supply to the solenoid 43 is started during the rotation of the swash plate 20 at the minimum inclination position, the pressure in the crank chamber 121 decreases, which promptly increases the inclination of the swash plate 20 with the help of the force of the restoration spring 27. Therefore, the displacement of the compressor is promptly restored.

(3) The restoration spring 27 expands to its original, or uncompressed length when the swash plate 20 is in a range from a predetermined position (other than the minimum inclination position) to the maximum inclination position. Accordingly, the restoration spring 27 in the present embodiment is shorter than the restoration springs in the prior art. The restoration spring in the prior art do not expand to their original lengths at the maximum inclination position of the swash plate 20 or before the swash plate 20 reaches the maximum inclination position. Also, the restoration spring 27 of the present embodiment is shorter when fully compressed than the prior art restoration springs. This reduces the axial length of the compressor.

(4) The snap ring 26 is fitted in the positioning groove 181, and the proximal end 271 of the restoration spring 27 is secured to the snap ring 26. Therefore, movement of the fixed end of the restoration spring 27 relative to the drive shaft 18 is prevented when the uncompressed length of the restoration spring 27 is less than the distance between the snap ring 26 and the swash plate 27. This prevents noise and damage to the restoration spring.

(5) Since the restoration spring 27 is a coil spring, the required characteristics of the spring are easily set.

(6) The minimum inclination position of the swash plate 20 corresponds to the full compression of the restoration spring. That is, the snap ring 26 and the restoration spring 27 determine the minimum inclination position of the swash plate 20. The minimum inclination position of the swash plate 20 is easily determined by forming the positioning groove 181 of the snap ring 26 at a predetermined position on the drive shaft 18.

(7) The proximal end 271 of the restoration spring 27 is easily secured to the snap ring 26. Also, the snap ring 26 is easily fitted in the positioning groove 181 on the drive shaft 18.

(8) In clutchless compressors, in which the drive shaft 18 continuously rotates as long as the vehicle engine is operating, it is important to minimize the minimum inclination of the swash plate 20 to reduce the consumption of power. The restoration spring 27 contributes to reducing the minimum inclination of the swash plate 20 and is especially suitable for clutchless compressors.

Figure 7:
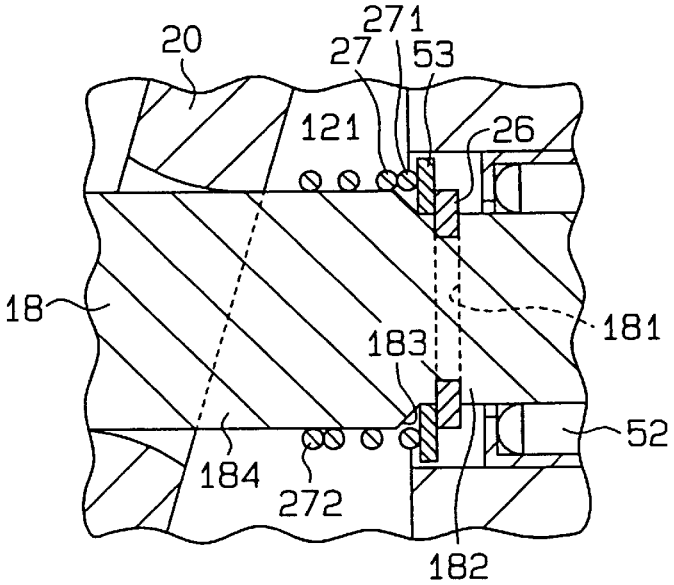
FIG. 7 is a partial cross sectional view showing a swash plate at the maximum inclination position in a compressor according to a second embodiment.

A second embodiment will now be described with reference to FIG. 7 and the description focuses on the differences from the first embodiment.

In the second embodiment, the drive shaft 18 includes a large diameter portion 184, a small diameter portion 182, and a step 183. The large diameter portion 184 contacts the swash plate 20, the radial bearing 52 is fitted on the small diameter portion 182, and the step 183 connects the large diameter portion 184 to the small diameter portion 182. A groove 181 is formed on the small diameter portion 182. The snap ring 26 is fitted in the groove 181. Compared to the first embodiment, the snap ring 26 is closer to the radial bearing 52. The step 183 is tapered. A positioning ring 53 is located between the snap ring 26 and the step 183. The proximal end 271 of the restoration spring 27 is secured to the positioning ring 53. The restoration spring 27 extends from the step 183 to the large diameter portion 184. The step 183 and the snap ring 26 prevent the positioning ring 53 from moving along the drive shaft 18.

Figure 8:
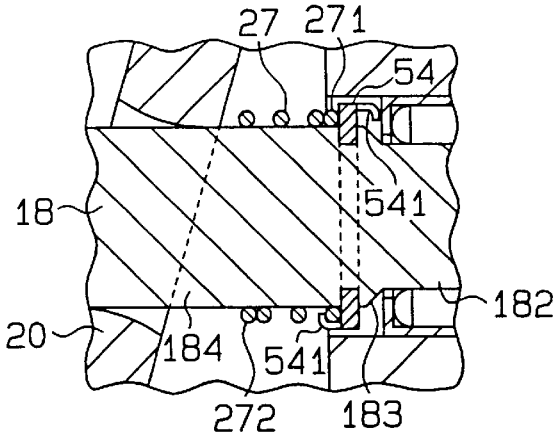
FIG. 8 is a partial cross sectional view showing a swash plate at the maximum inclination position in a compressor according to a third embodiment.

A third embodiment will now be described with reference to FIG. 8 and the description is focused on the differences from the first embodiment.

In the third embodiment, the snap ring 54 integrally includes a pair of retaining pieces 541. One of the retaining pieces 541 presses the proximal end 271 of the restoration spring 27 against the surface of the drive shaft 18 and retains the restoration spring 27. Therefore, the axial movement of the entire restoration spring 27 is prevented.

Figure 9:
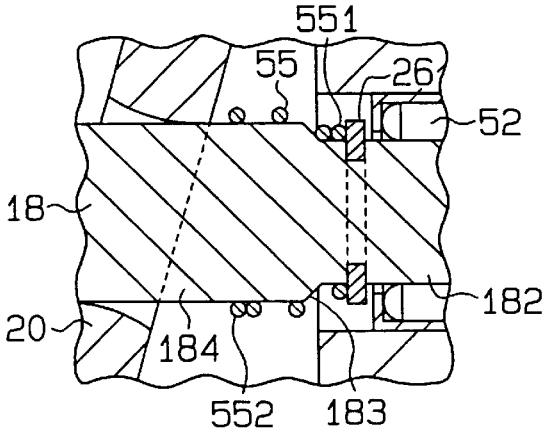
FIG. 9 is a partial cross sectional view showing a swash plate at the maximum inclination position in a compressor according to a fourth embodiment.

A fourth embodiment will now be described with reference to FIG. 9 and the description is concentrated on the differences from the second embodiment.

In the fourth embodiment, the shape of the restoration spring 55 is different. The diameter of the restoration spring 55 at the proximal end 551 is smaller and corresponds to the small diameter portion 182 of the drive shaft 18. The diameter of the distal end 184 of the restoration spring 55 is greater than the diameter of the small diameter portion 182, and the diameter of the proximal end 551 is smaller than that of the large diameter portion 184. When not compressed, the restoration spring 55 extends axially from the step 183 along the large diameter portion 184. The proximal end 551 is located between the snap ring 26 and the step 183. Therefore, axial movement of the proximal end of the restoration spring 55 is prevented.

Figure 10:
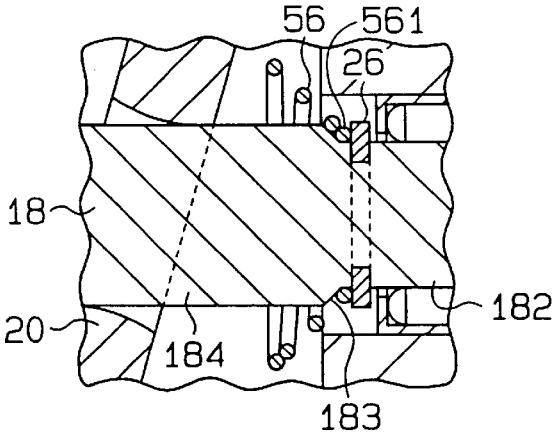
FIG. 10 is a partial cross sectional view showing a swash plate at the maximum inclination position in a compressor according to a fifth embodiment.

A fifth embodiment will now be described with reference to FIG. 10 and the description focuses on the differences from the fourth embodiment.

In the fifth embodiment, the restoration spring 56 is a tapered coil spring. The snap ring 26 is located on the small diameter portion 182. The diameter of the proximal end 561 of the restoration spring 56 is about the same as that of the small diameter portion 182. The snap ring 26 and the step 183 fix the proximal end 561. Therefore, the axial movement of the proximal end of the restoration spring 56 is prevented.

The first to fifth embodiments may be varied as follows.

Each restoration spring 27, 55, 56 may be a leaf spring.

The proximal end of each restoration spring 27, 55, 56 may be directly fixed to the drive shaft 18.

One end of each restoration spring 27, 55, 56 may be secured to a member (for example, the swash plate 20) that integrally rotates with the drive shaft 18, and the other end may be free.

A clutch may be provided between the external drive source and the drive shaft 18.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A variable displacement compressor, wherein the displacement is varied by controlling the pressure in a crank chamber, the compressor comprising:

a drive shaft;

a piston for compressing a gas;

a swash plate located in the crank chamber, wherein the swash plate integrally rotates with the drive shaft, wherein the inclination of the swash plate relative to the drive shaft determines the stroke of the piston, wherein the inclination of the swash plate is varied between a maximum inclination position and a minimum inclination position;

a displacement restoration spring for urging the swash plate to increase its angle, wherein the restoration spring fails to urge the swash plate when the swash plate is positioned at or near the maximum inclination position, one end of the restoration spring being fixed to a predetermined part of the drive shaft.

2. The compressor according to claim 1, wherein the minimum inclination position of the swash plate is determined by the length of the restoration spring when fully compressed.

3. The compressor according to claim 1 further including a disinclination spring for urging the swash plate toward the minimum inclination position, wherein, when the compressor is stopped, the swash plate is positioned at a predetermined start inclination position at which the forces of the reduction spring and the restoration spring are balanced.

4. The compressor according to claim 3, wherein the inclination of the swash plate at the predetermined start inclination position is greater than that of the minimum inclination position.

5. The compressor according to claim 3, wherein the disinclination spring is located on the opposite side of the swash plate from the restoration spring and is coaxial with the restoration spring.

6. The compressor according to claim 1, further including an annular positioning member which fixes the restoration spring to the drive shaft.

7. The compressor according to claim 6, wherein a proximal end of the restoration spring is fixed to the annular positioning member, and the distal end of the restoration spring is free.

8. The compressor according to claim 7, wherein the restoration spring is a coil spring that surrounds the drive shaft.

9. A variable displacement compressor, wherein the displacement is varied by controlling the pressure in a crank chamber, the compressor comprising:

a drive shaft;

a swash plate located in the crank chamber, wherein the swash plate integrally rotates with the drive shaft, wherein the inclination of the swash plate relative to the drive shaft is varied between a maximum inclination position and a minimum inclination position;

a piston, the stroke of which is determined by the inclination of the swash plate;

a displacement restoration spring for urging the swash plate to increase its inclination; and a positioning member for fixing one end of the restoration spring to a predetermined part of the drive shaft, wherein the positioning member and the restoration spring determine the minimum inclination position of the swash plate, wherein the length of the restoration spring is less than the distance along the drive shaft between the swash plate and the positioning member when the swash plate is at the maximum inclination position.

10. The compressor according to claim 9 further including a disinclination spring for urging the swash plate toward the minimum inclination position, wherein, when the compressor is stopped, the swash plate is positioned at a predetermined start inclination position at which the forces of the reduction spring and the restoration spring are balanced.

11. The compressor according to claim 10, wherein the inclination of the swash plate at the predetermined start inclination position is greater than that of the minimum inclination position.

12. The compressor according to claim 9, wherein the positioning member is a snap ring that is fixed on the drive shaft.

13. The compressor according to claim 12, wherein a proximal end of the restoration spring is fixed to the snap ring, and the distal end of the restoration spring is free.

14. The compressor according to claim 13, wherein the restoration spring is a coil spring that surrounds the drive shaft.

15. The compressor according to claim 14, wherein the restoration spring is a deformed coil spring that surrounds the drive shaft, and the diameter of the proximal end of the deformed spring is smaller than that of the distal end.

16. The compressor according to claim 15, wherein the drive shaft includes a small diameter portion, a large diameter portion, and a step connecting the small diameter portion to the large diameter portion, wherein the positioning member is a snap ring attached to the small diameter portion, and the proximal end of the deformed coil spring is located at the small diameter portion between the snap ring and the step.

17. The compressor according to claim 15, wherein the drive shaft includes a small diameter portion, a large diameter portion, and a step connecting the small diameter portion to the large diameter portion, wherein the positioning member is a snap ring attached to the small diameter portion, and the proximal end of the deformed coil spring is located at the step.

* * * * *